US006588914B1

(12) United States Patent
Tang

(10) Patent No.: US 6,588,914 B1
(45) Date of Patent: Jul. 8, 2003

(54) ARTIFICIAL TREE WITH DECORATIVE LAMPS

(76) Inventor: Tai-Ning Tang, 581 Kamoku St. #3506, Honolulu, HI (US) 96826

( * ) Notice: Subject to any disclaimer, the term of this patent is extended or adjusted under 35 U.S.C. 154(b) by 0 days.

(21) Appl. No.: 10/046,181

(22) Filed: Jan. 16, 2002

(51) Int. Cl.[7] ..... F21S 6/00
(52) U.S. Cl. ..... 362/123; 362/252; 362/806
(58) Field of Search ..... 362/123, 806, 362/252

(56) References Cited

U.S. PATENT DOCUMENTS 5,455,750 A * 10/1995 Davis et al. ..... 525/84
5,550,720 A * 8/1996 Carroll ..... 362/123
6,457,839 B1 * 10/2002 Grandoit ..... 362/123
6,458,435 B1 * 10/2002 Lai ..... 428/20

* cited by examiner

*Primary Examiner*—Sandra O'Shea

*Assistant Examiner*—Guiyoung Lee

(74) *Attorney, Agent, or Firm*—Rabin & Berdo, P.C.

(57) ABSTRACT

An artificial tree structure with decorative lamps, comprising a plurality of hollow tubes or iron wires of various lengths, in the shape of tree branches, arranged from top to bottom around the main trunk supported by detachable legs. On each side sticks are installed a plurality of iron wires to form the shape of tree branches. The exterior of the hollow tubes or iron wires is wound by dense tree leaves. The lamps installed in the hollow tubes or on the iron wires are serially connected to become decorative lamp strings. The decorative lamp strings are then combined in parallel connection, running down the main trunk to be connected to a control box and a power transformer. The structure described above provides the artificial tree with decorative lamps, using the control box to produce music and lighting effects of different luminosity and flashing speeds.

8 Claims, 14 Drawing Sheets

ARTIFICIAL TREE WITH DECORATIVE LAMPS

BACKGROUND OF THE INVENTION (a) Field of the invention

The invention relates to an artificial tree structure with decorative lamps, particularly an artificial tree with detachable legs supporting a main trunk, with hollow tubes or iron wires in the shape of tree branches hanging around the main trunk, the exterior of the tree branches being wound by tree leaves, at appropriate locations on the hollow tubes or the iron wires are one or more lamp bulbs in serial connection. An electric wire conducting the lamp bulbs is hidden inside the hollow tubes, or winding on the exterior of the iron wires to form decorative lamp strings. The decorative lamp strings are then combined in parallel connection and connected to a control box and a power transformer, to combine the artificial tree with the decorative lamps as one unit, achieving the purposes of enhancing the convenience of decorating the artificial tree, easy storage of the decorative lamps and the tree body, durability and security of the decorative lamps.

(b) Description of the Prior Art

Due to advancement of data information technology, as well as frequent exchanges between peoples around the world, regional festivals have become holidays the world over, such as Christmas, Thanksgiving, Halloween, Easter, Valentine's Day, etc. Christmas, in particular, has become a worldwide greeting season when people would put up natural or artificial Christmas trees at various locations. Generally there are little presents lying under or on the tree. On the branches of the Christmas tree, we can often see little lamps flashing on and off in various colors. In conventional Christmas trees, the tree body and the decorative lamps are two separate entities. The user has to combine the two for use, or separate them when not in use. That conventional model of Christmas tree has the following shortcomings:

(1) The user has to purchase the Christmas tee and the decorative lamps separately and spend more money on them.

(2) When the Christmas tree is to be displayed, the user must bring the decorative lamps and wind them on the surface of the tree, which is quite troublesome in arrangement, and the user has to pay attention to the winding angles and the intervals of each spiral thread, or in case the lamps are unevenly distributed, or the electrical wire is tangled up, the lighting effects could be reduced significantly.

(3) The decorative lamps hanging on the Christmas tree (high voltage, such as 120V or 240V lamps) could easily be removed, relocated, fall off or even tangled, when the user tries to hang other decorative items or when children are touching the tree when they are playing around the tree. In that case, the lamps and electric wire could be damaged, resulting in short-circuit, electric shock, or even a fire.

(4) To store the Christmas tree and the decorative items thereon, the user could find it much trouble to untangle the decorative lamp strings winding around the tree, and carefully collect the lamps and electric wires neatly after they are removed from the tree, (and avoid them from being tangled up, or they could not be spread smoothly for reuse the next time) and store them separately for next year. The disassembling and storing processes could be very inconvenient.

SUMMARY OF THE INVENTION

In view of those shortcomings, the inventor has devoted to research and development, based on many years experience in the production of related giftware and decorative items, and after repeated conceptions, test production, lab tests and revisions has come up with the present invention to combine a Christmas tree and decorative lamps as one unit, so that all branches of the artificial tree could be properly dotted with one or more flashing lamps, thereby achieving the purposes of convenience in the arrangement and storage of the artificial tree, durability and security in the use of the decorative lamps, and economic efficiency.

BRIEF DESCRIPTION OF DRAWINGS

The following and other features and advantages of the present invention will be more easily understood from the following detailed description and the accompanying drawings, in which.

DETAILED DESCRIPTION OF PREFERRED EMBODIMENTS

For better understanding of the structural features and anticipated performance of the present invention, please refer to the detailed description and drawings as follows.

Figure 1:
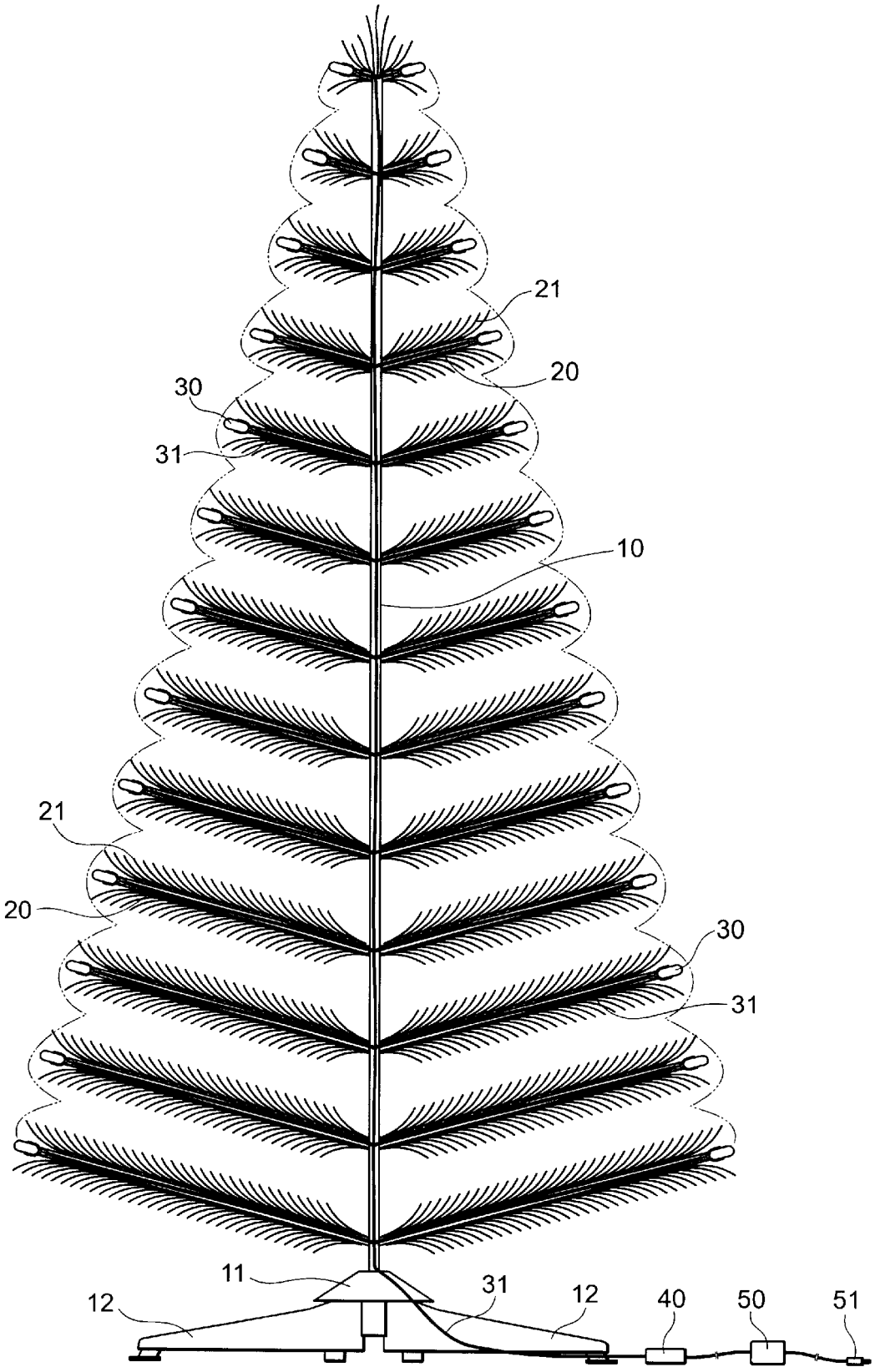
FIG. 1 is a schematic view of the invention using hollow tubes as branches and the main trunk as an integrated unit.
Figure 2:
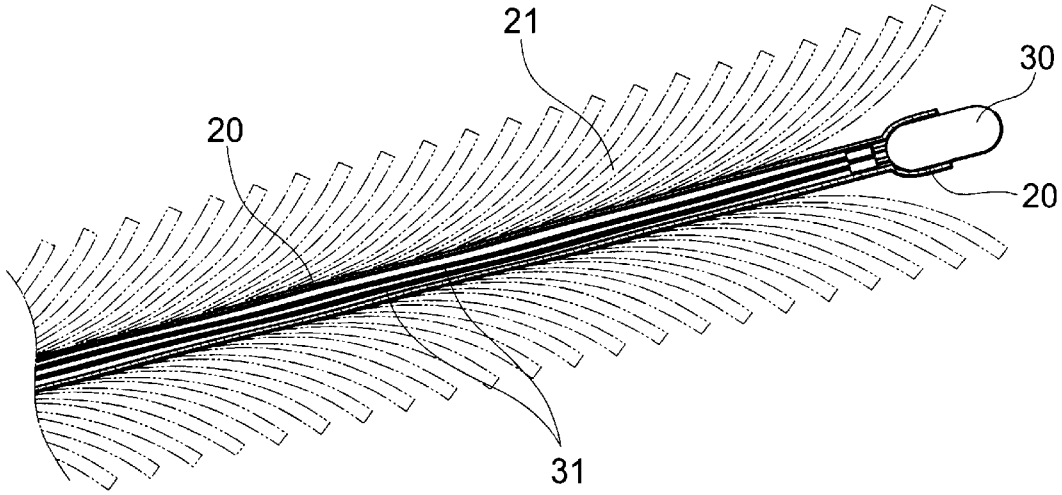
FIG. 2 is a schematic view of the invention with lamp bulbs installed at the ends of the hollow tubes.
Figure 3:
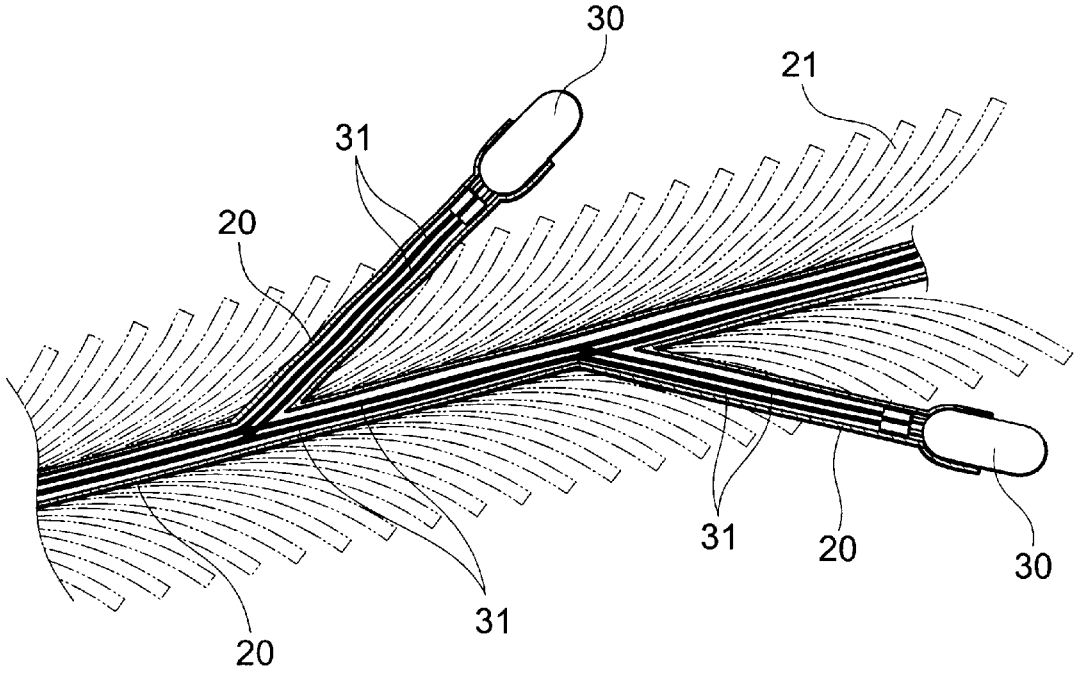
FIG. 3 is a schematic view of the invention with a plurality of lamp bulbs installed on the hollow tubes.
Figure 4:
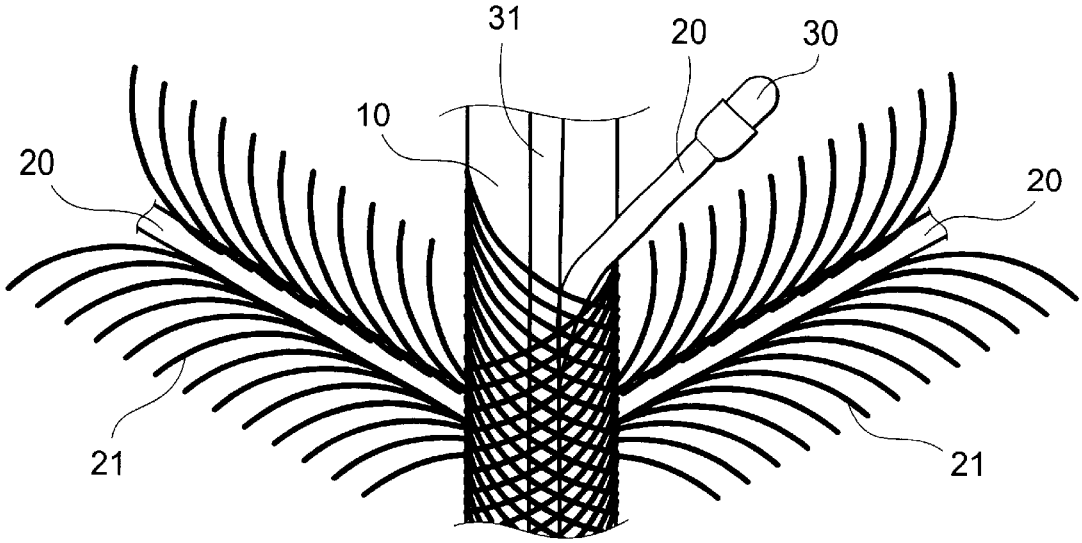
FIG. 4 is a schematic view of the invention with lamp bulbs installed on the main trunk.
Figure 5:
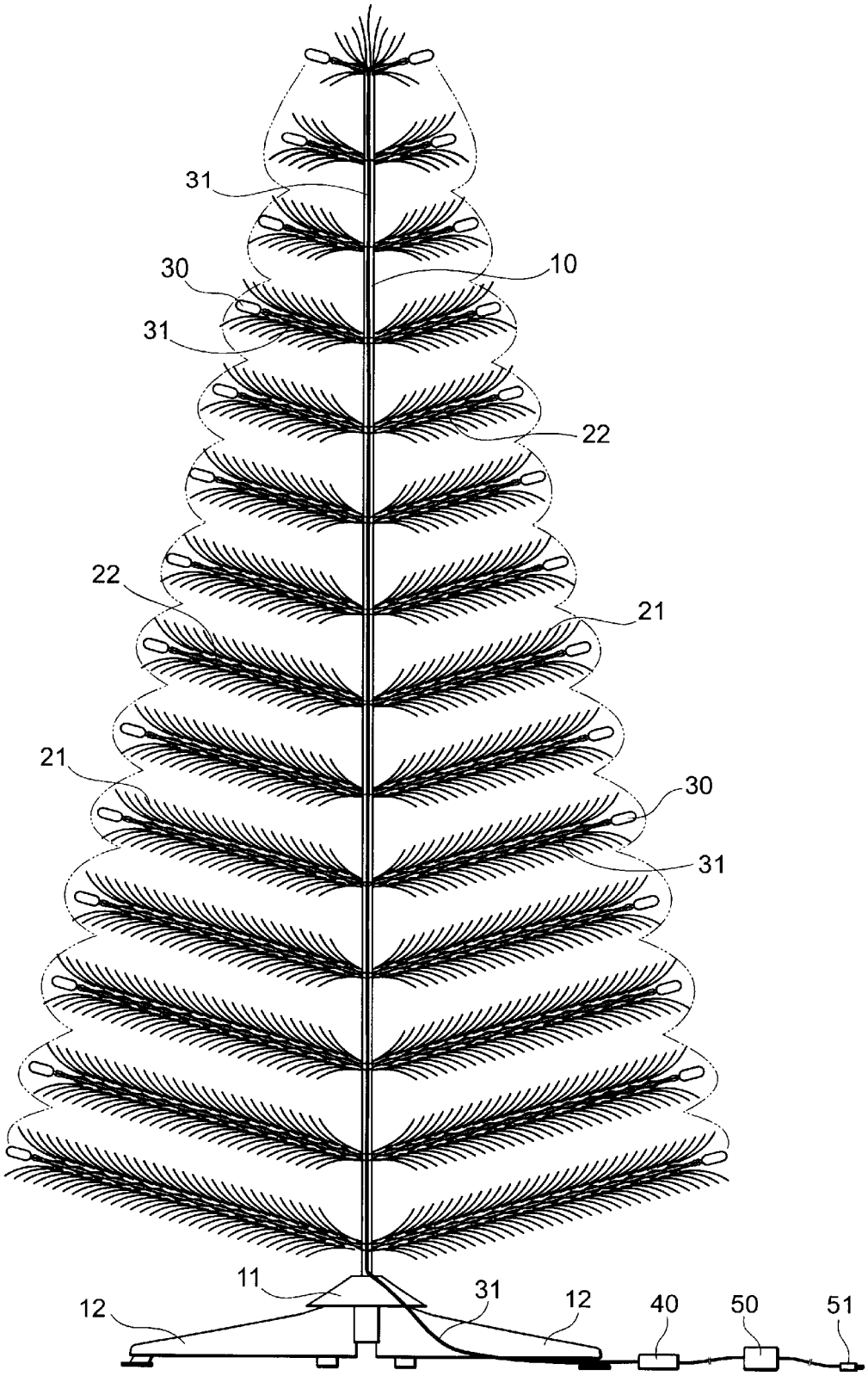
FIG. 5 is an embodiment view of the invention using iron wires as branches and the main trunk as one integrated unit.
Figure 6:
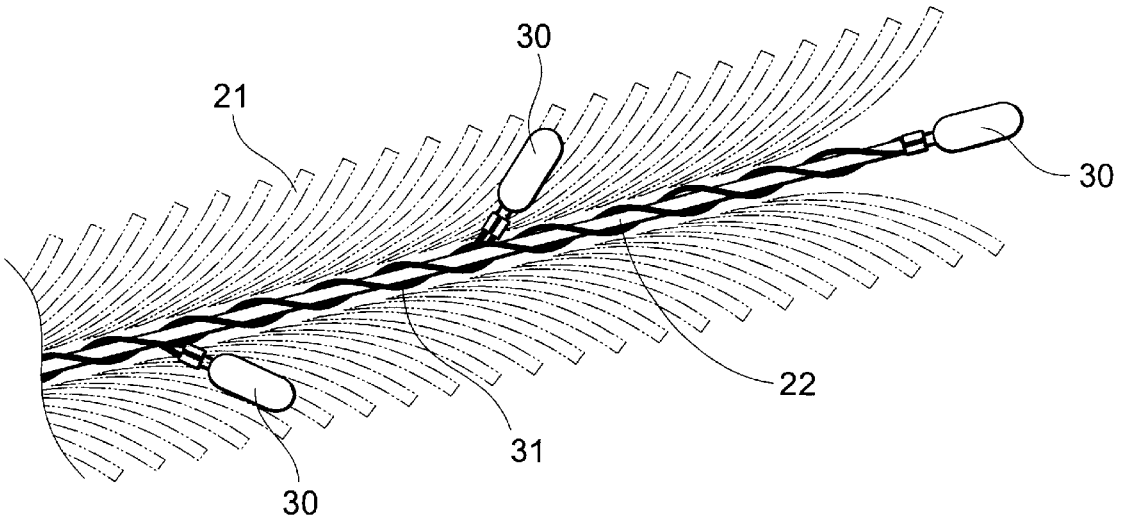
FIG. 6 is a schematic view of the invention with a plurality of lamp bulbs installed on the iron wires.
Figure 7:
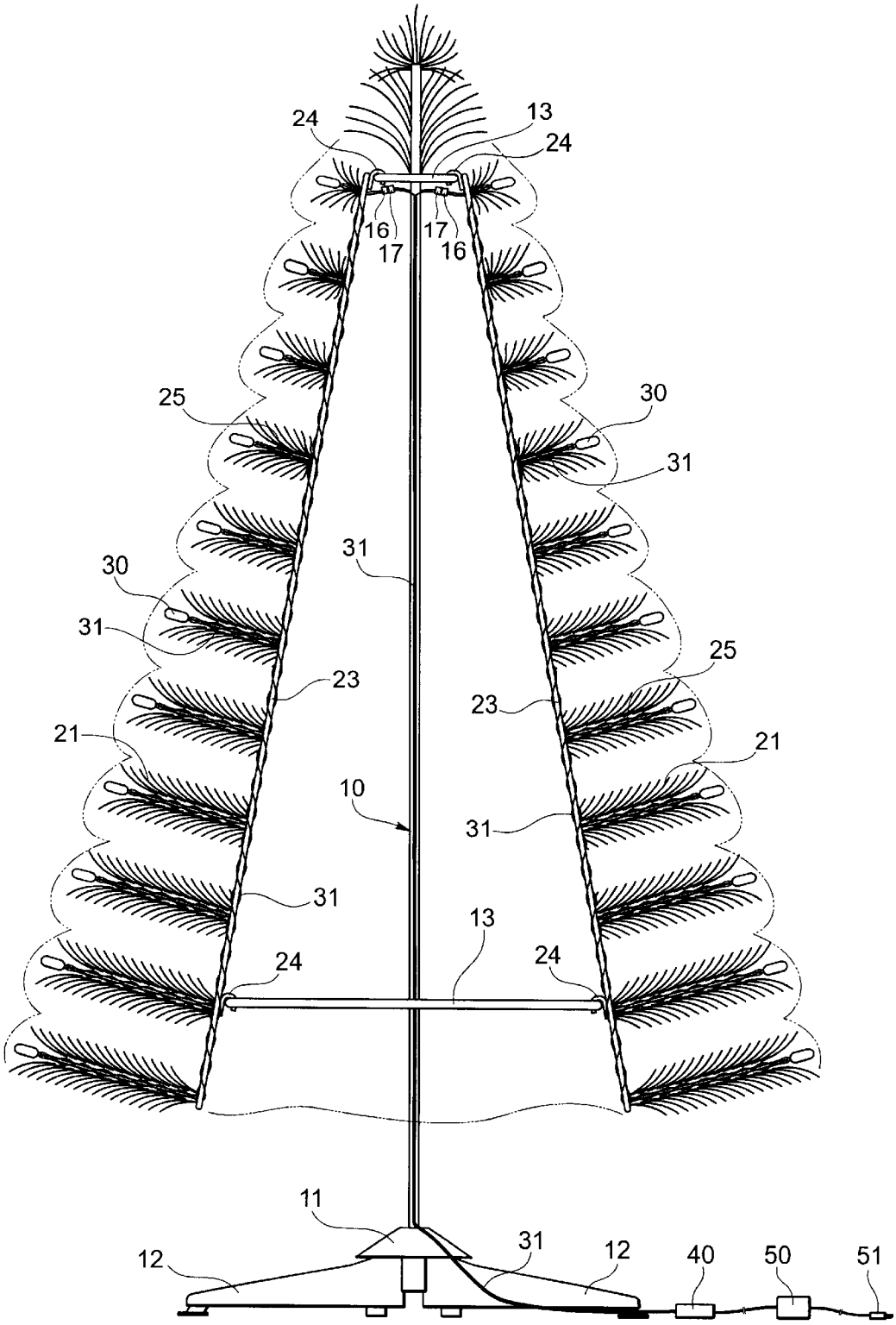
FIG. 7 is an embodiment view of the invention with a plurality of side sticks hanging around the main trunk to form a Christmas tree.
Figure 8:
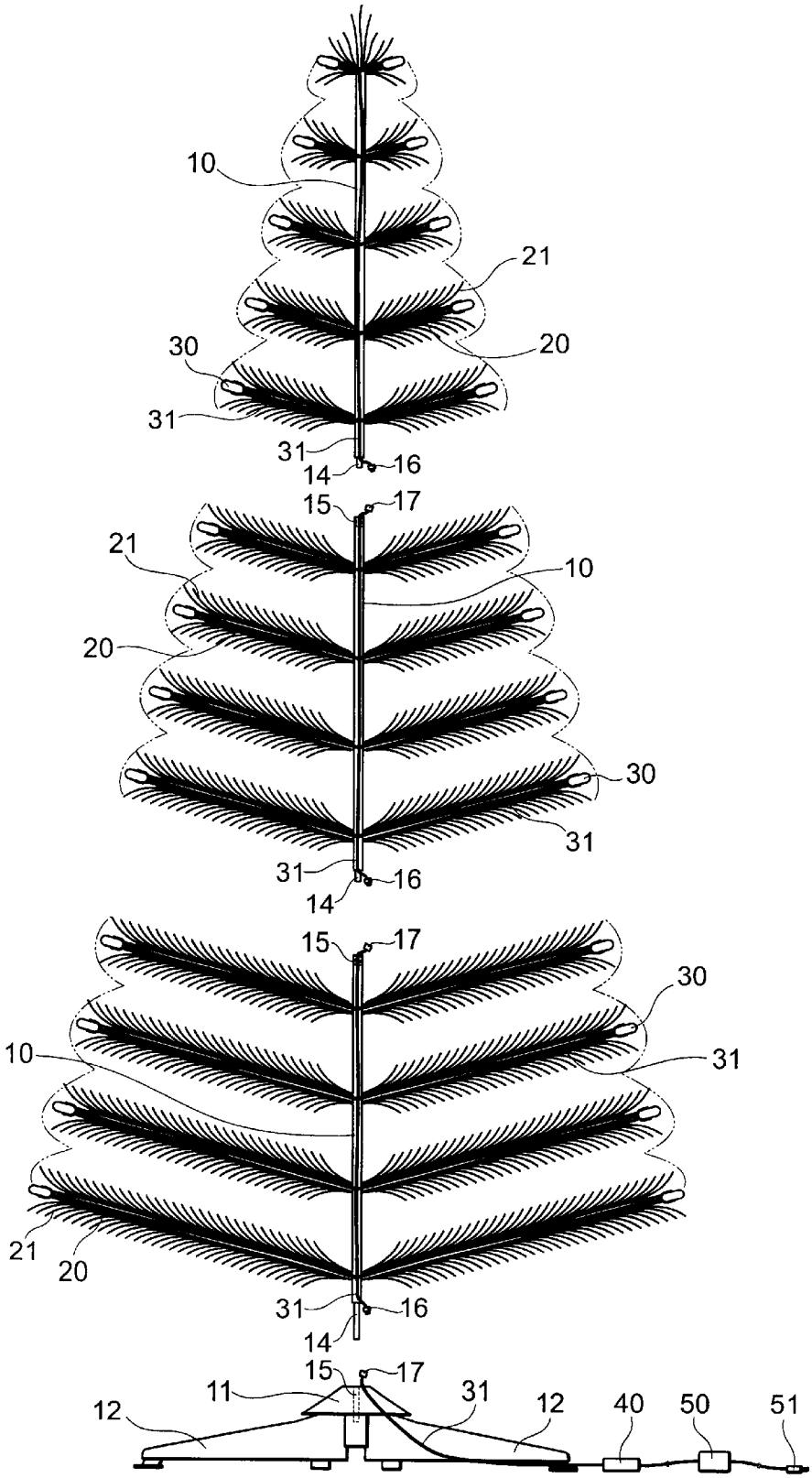
FIG. 8 is a disassembled view of the invention with multiple sections of the main trunk.
Figure 9:
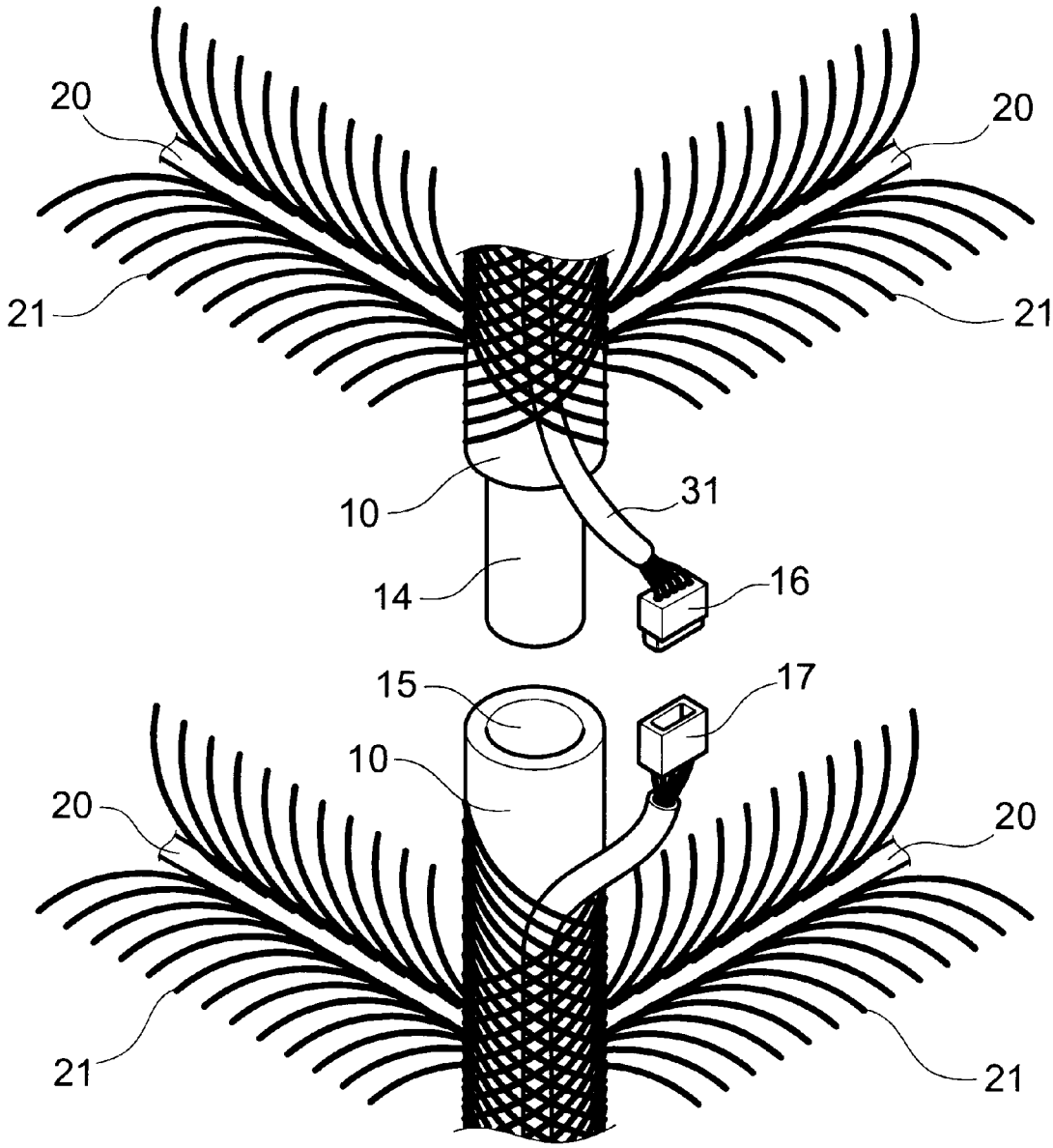
FIG. 9 is a view of the joints of all sections of the main trunk in the construction of multiple sections of the main trunk of the invention.
Figure 10:
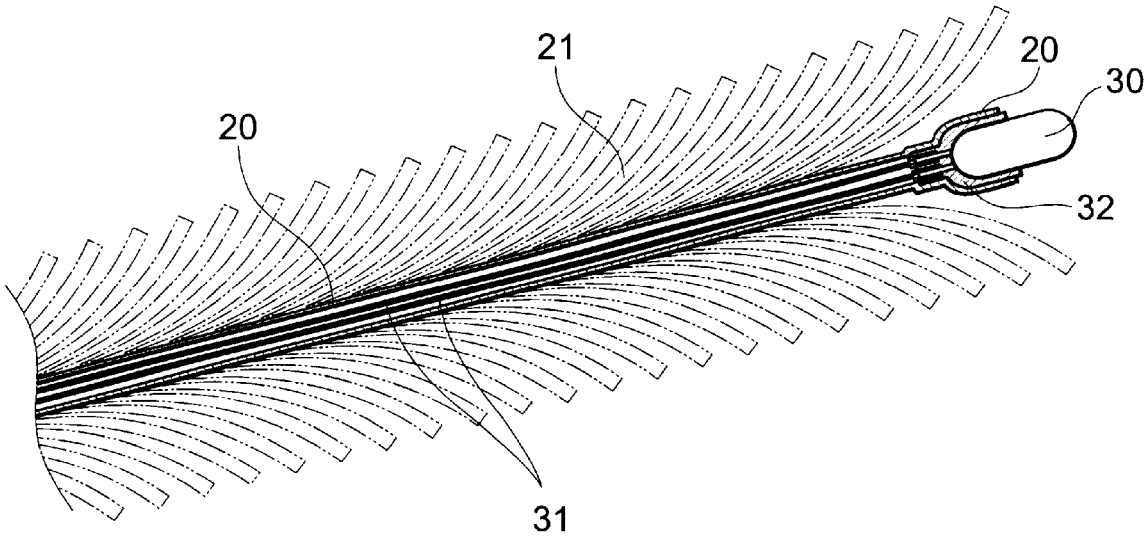
FIG. 10 is a schematic view of the invention with lamp holders at the ends of the hollow tubes.
Figure 11:
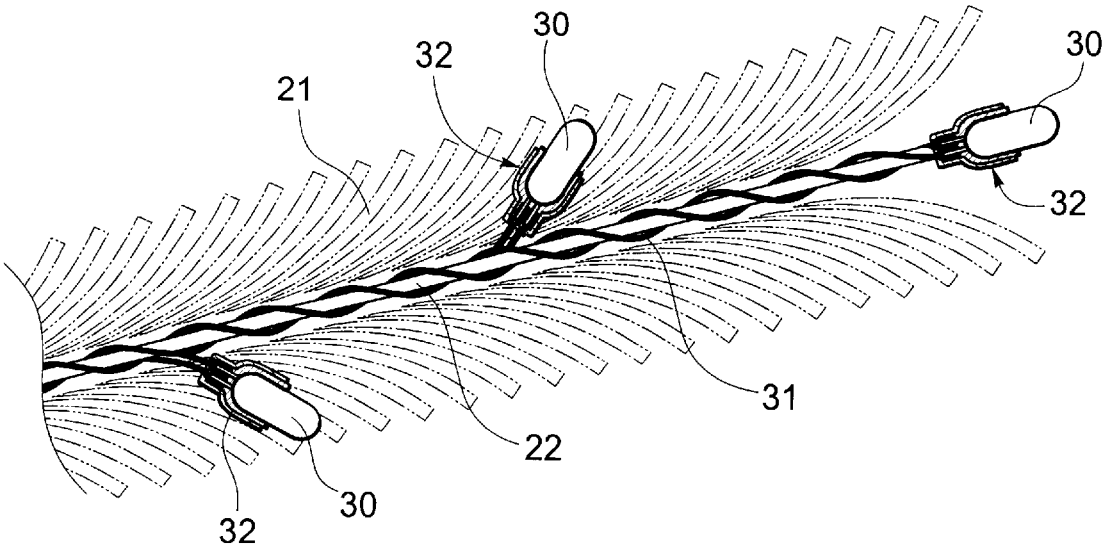
FIG. 11 is an embodiment view of the invention with a plurality of lamp holders installed on the decorative lamp string hanging on the iron wires.

As shown in FIGS. 1 and 2, the invention comprises a main trunk 10 that serves as a foundation, a base 11 below the main trunk 10, and a plurality of detachable legs 12 that are equally spaced below the base 11. The legs 12 serve to erect the main trunk 10. Around the main trunk and roughly equally spaced are a plurality of hollow tubes 20 that are configured as tree branches and arranged to have longer branches at the bottom and shorter branches at the top of the main trunk 10. There are dense leaves 21 winding around the exterior of each hollow tube 20. At specified locations of the tube is installed at least one lamp bulb 30. The lamp bulbs 30 are serially connected to become a string of decorative lamps. FIG. 2 shows the installation of a lamp bulb 30 at the end of the tube. FIG. 3 shows a preferred embodiment of a plurality of lamp bulbs 30 installed on secondary hollow tubes that are connected at a middle section of the primary tube. FIG. 4 shows the installation of a lamp bulb 30 on the main trunk 10. All strings of decorative lamps are connected to an electric wire 31 that is hidden within the hollow tube 20, extending toward the main trunk 10. All strings of decorative lamps on all hollow tubes 20 (or on the main trunk 10) are combined in parallel connection, before they are pulled along the main trunk 10 to a lower part of the main trunk 10, and connected to a control box 40 containing circuit control devices including a lighting timing control and a music IC control, then connected to a power transformer 50 that supplies a rectified power with a reduced voltage. In addition to the hollow tubes 20 employed for the branches in the aforementioned embodiment of the invention, iron wires 22 are used optionally to replace the hollow tubes 20, as shown in FIG. 5, using a plurality of iron wires 22 of unequal lengths arranged around the main trunk 10 at roughly equal spaces from each other from the top to the bottom of the main trunk 10, to look as branches. In addition to dense leaves 21 winding on the exterior of the iron wires 22, there is at least a string of lamp bulbs 30 installed on the main trunk 10, as shown in FIG. 6, wherein the lamp bulbs 30 are connected serially by an electric wire 31 to become a decorative lamp string. The electric wire 31 of the decorative lamp string runs around the iron wire 22 and extends toward the main trunk 10. All the decorative lamp strings on the iron wires 22 are combined in parallel connection, running down the main trunk 10 to connect with the control box 40 and the power transformer 50. As an alternative to the hollow tubes 20 and iron wires 22 installed around the main trunk 10 as described above in the configuration of branches, the invention has a plurality of fixing rings 13 of various diameters with a plurality of side sticks 23 arranged at specified heights on the main trunk 10, as shown in FIG. 7. Each side stick 23 has a specified number of hook units 24 installed at positions where the side stick 23 intersects with the fixing rings 13, so the hook units 24 are hooked and fastened to the fixing rings 13. Each side stick 23 has a plurality of iron wires 25 that are roughly spaced equally from each other thereon. Each iron wire 25 is surrounded by leaves 21, as well as a decorative lamp string consisting of from one to a specified number of lamp bulbs 30 that are serially connected by the electric wire 31. All decorative lamp strings on each side stick 23 are serially connected. All side sticks 23 are hooked by the hook units 24 to the fixing rings 13, and hang around the main trunk 10, constituting the appearance of an entire Christmas tree. The decorative lamp strings winding on the side sticks 23 are then connected to the electric wire 31 on the main trunk 10 by a plug 16 and a socket 17 that can be plugged to or unplugged from each other, then they are combined in parallel connection and extended along the main trunk 10 to be connected to the control box 40 and the power transformer 50. As an alternative to the integrated unit described above, the structure of the main trunk 10 is designed in multiple sections to adapt to a Christmas tree with larger measurements, as shown in FIGS. 8 and 9 (showing a configuration of branches using hollow tubes 20), between the sections of the main trunk 10 and at the joints between the main trunk 10 and the base 10, there are matching protruded posts 14 and depressed grooves 15 that can be engaged to and disengaged from each other. In this configuration, the electric wire 31 on the main trunk 10 is also divided in multiple sections to coordinate with the sections of the main trunk 10 and the base 11, having a plug 16 and a socket 17 at each joint, for electrical connection when the respective sections of the main trunk 10 are joined, and the combined main trunk 10 is joined with the base 11. Optionally, there is an additional lamp holder 32 installed at where a lamp bulb 30 is located on the electrical wire 31 of each decorative lamp string, as shown in FIGS. 10 and 11 (the two drawings showing respectively a lamp bulb 30 installed at an end of a hollow tube unit, and at the iron wire 22), the lamp holder 32 enabling the lamp bulb 30 to plug in or be unplugged conveniently, so the user can conveniently replace it with a lamp bulb 30 of a different color, or to replace a defective lamp bulb 30.

Figure 12:
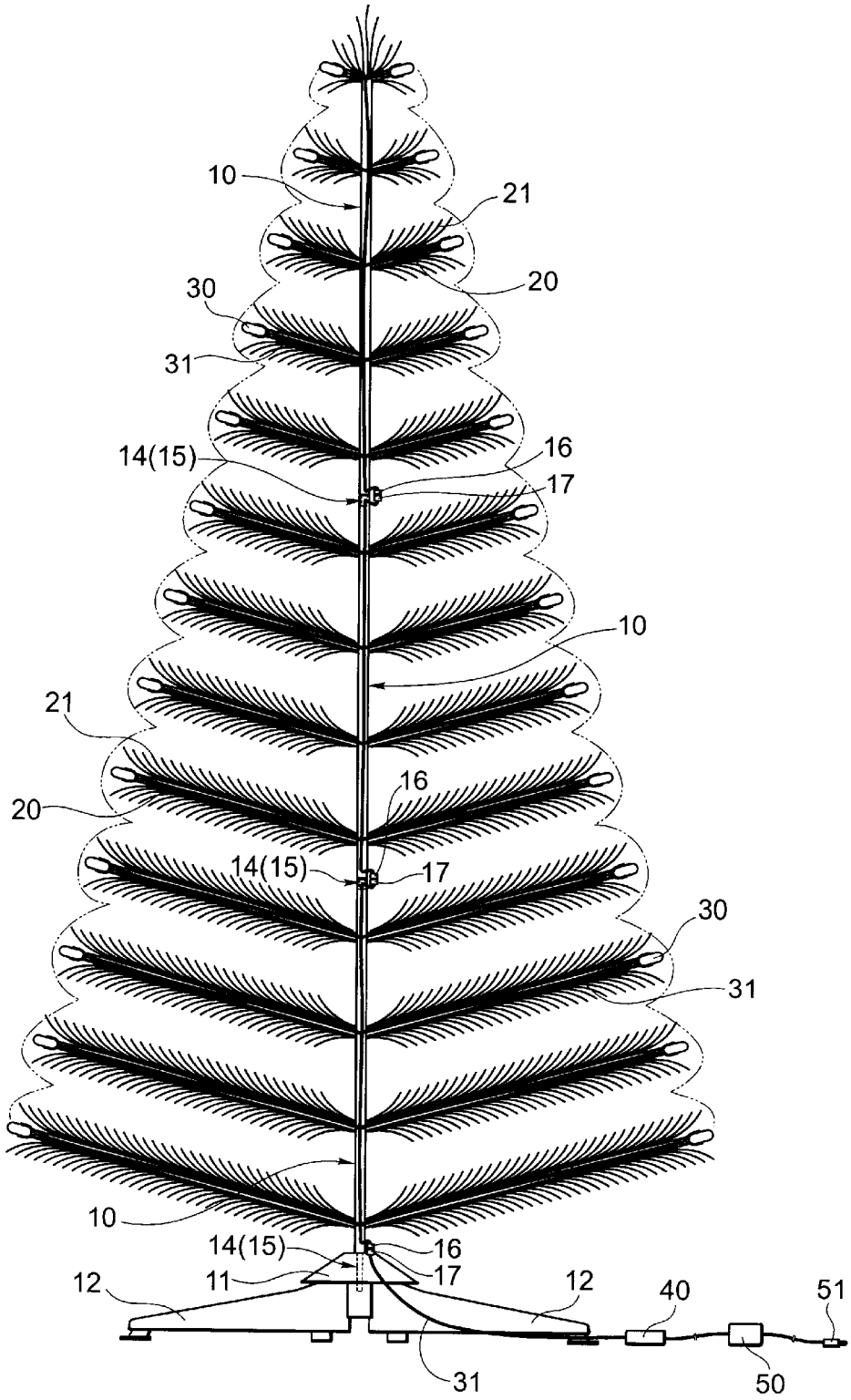
FIG. 12 is an assembled view of the invention with multiple sections of the main trunk.

As described above, the decorative lighting fixture consisting of a plurality of lamp bulbs 30 and electrical wires 31 is combined with an artificial tree, smartly hidden inside branch-shaped hollow tubes 20, or distributed on branch-like iron wires 22, 25. To use, in case it is an integrated shape of main trunk 10, the hollow tubes 20 or iron wires 22, 25 are spread neatly (as shown in FIGS. 1, 5 and 7) to configure an artificial Christmas tree with dense leaves. In case it is a multiple-section construction of main trunk 10, as shown in FIG. 12 (the embodiment shows the type using hollow tubes 20), respective sections of the main trunk 10 and the base 11 are assembled and erected using the protruded posts 14 and depressed grooves 15, then the respective sections of electric wire 31 are connected by means of plugs 16 and sockets 17. After the assembly, the plug 51 at the end of the power transformer 50 is inserted in a power outlet on the wall for access to a power supply after the power is rectified and its voltage lowered, then, through the control circuit inside the control box 40, the lamp bulbs 30 embedded in the surface of the artificial tree will create special effects such as intermittent lighting on and off, at different intervals and with different degrees of luminosity, which produce an atmosphere of warm and romantic feeling, providing at least the following physical effects:

(1) The artificial tree itself is a decorative lighting fixture creating flashing effects, therefore, consumers can purchase two items at one time that would have been purchased separately, which reduced trouble, and due to the reduced cost of the invention, it offers cheaper selling prices (as related to the total price of conventional artificial Christmas tree decorative lamp strings.)

(2) In case an integrated form of main trunk 10 is used for the installation of the artificial tree, the user has only to spread evenly the branches (i.e. the hollow tubes 20, or the iron wires 22 or the side sticks 23 and the iron wire 25) (as shown in FIGS. 1, 5 and 7), then all the lamps 30 are put in respective positions, and when a structure of multiple-section type main trunk 10 is adopted, a quite simple method of insertion can be used to combine respective sections of the main trunk 10 and the base 11, and all sections of the electric wire 31, and in a similar way to spread neatly all hollow tubes 20 or iron wires 22 or side sticks 23 and iron wires 25 (as shown in FIG. 12, which shows an example using hollow tubes 20) to arrange all the lamp bulbs 30 in place. In this way, the invention is free from the trouble of winding additional decorative lamp strings, as in conventional models.

(3) Since the decorative lamp fixture is delicately combined with the artificial tree, we can arrange other decorative items on the artificial tree, or move the artificial tree, without having to worry that the lamp bulbs 30 will fall off or be broken. So the invention is durable and safe in use.

Figure 13:
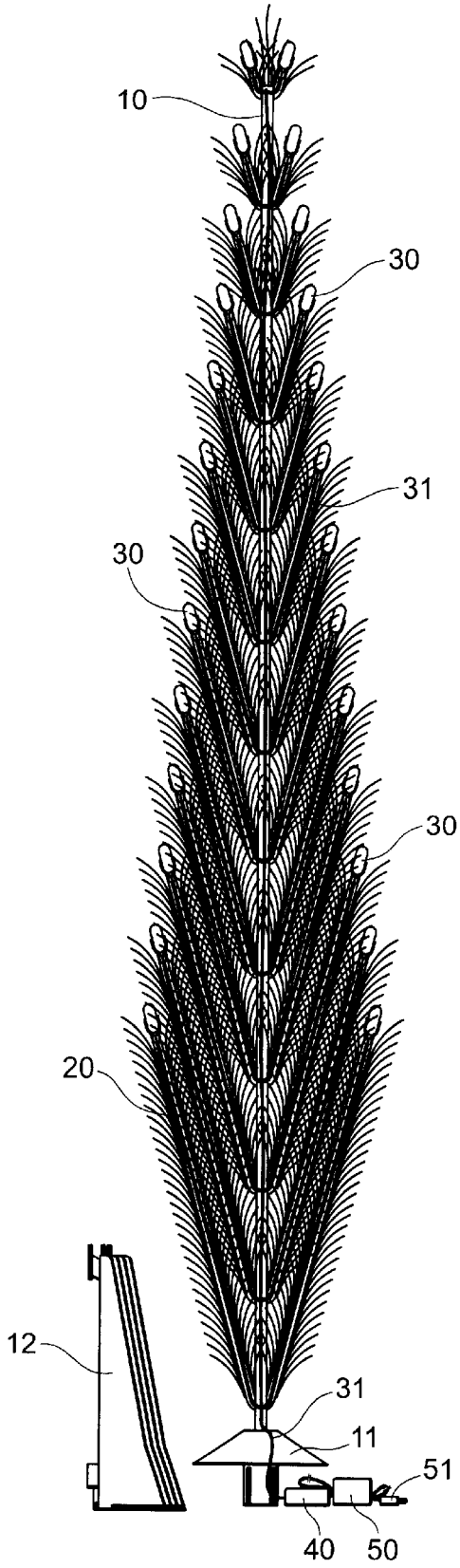
FIG. 13 is a view of the invention with an integrated form of the main trunk when it is folded.
Figure 14:
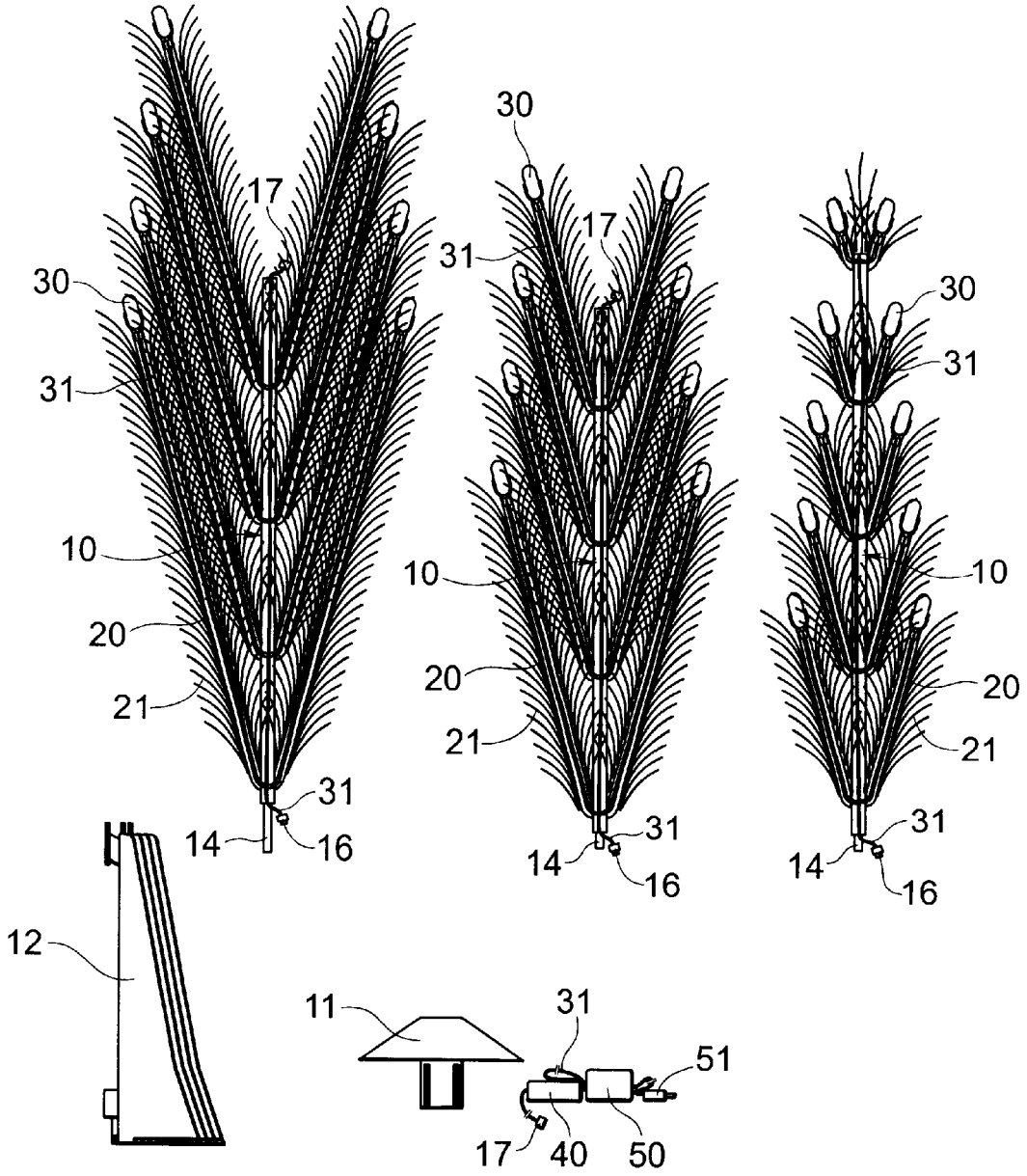
FIG. 14 is a view of the invention with multiple sections of the main trunk when it is folded.

(4) To store an artificial tree of an integral form of main trunk 10, the user need only collect all the hollow tubes 20 or the iron wires 22 in the direction of the main trunk 10, or separate all side sticks 23 from the main trunk 10, and collect the iron wires 25 and side sticks 23 thereon, then dismantle the legs 12 at the base 11, as shown in FIG. 13 (hollow tubes are used in this embodiment). And in case of multiple-section main trunk 10 construction, the user need only disassemble all sections of the main trunk 10, the base 11 and all sections of electric wire 31, and collect the hollow tubes 20 or iron wires 22 on the sections of the main trunk 10 in the direction of the main trunk 10, and remove the legs 12 at the bottom of the base 11, as shown in FIG. 10 (hollow tubes are used in this embodiment), then the measurements of the artificial tree can be reduced significantly for easy storage. When the artificial tree body is collapsed, the decorative lamp fixture is also collected for convenient storage.

To conclude, the present invention has delicate design and unique construction, enabling the combination of the artificial tree with decorative items, to effectively improve on the shortcomings of conventional models. With its inventive step, improvement and practical efficiency, this application is filed. Your favorable consideration will be appreciated.

What is claimed is:

1. An artificial tree structure with decorative lamps, comprising:

a main trunk serving as a foundation;

a plurality of detachable legs disposed below a base of said main trunk and being equally spaced from each other;

a plurality of primary hollow tubes having various lengths and being disposed around said main trunk and roughly spaced equally from each other and arranged from a bottom to a top of said main truck in the shape of tree branches;

a plurality of secondary hollow tubes, at least one secondary hollow tube being connected to one of said primary hollow tubes to form further tree branches;

dense leaves disposed around an exterior of said hollow tubes;

a plurality of lamp bulbs, with at least one lamp bulb being disposed on each respective primary and secondary hollow tube; and a plurality of electric wires, at least one electric wire being disposed at said main trunk, and at least one electric wire being disposed inside each respective primary and secondary hollow tube, the respective electric wires disposed inside the hollow tubes being electrically connected to the respective lamp bulbs and to the electric wire disposed in at said main trunk.

2. The artificial tree with decorative lamps of claim 1, wherein said main trunk is comprised of multiple sections joined together at joints, at the joints between the sections of said main trunk are protruded posts and depressed grooves that can be engaged to and disengaged from each other, and the electric wire at the main trunk is also divided in different sections joined together at joints, at the joints between the sections of the electric wire are installed plugs and sockets that can be engaged to or disengaged from each other.

3. The artificial tree with decorative lamps of claim 1, further comprising lamp holders installed on the hollow tubes, the respective electric wires inside the respective hollow tubes being connected with the lamp holders, the lamp holders can be electrically connected with or disconnected from the lamp bulbs.

4. The artificial tree with decorative lamps of claim 1, wherein the lamp bulb disposed on each respective hollow tube is located at an outermost distal end thereof so as to be coaxially arranged with said hollow tube.

5. The artificial tree with decorative lamps of claim 1, further comprising a control box for causing the lamp bulbs to flash on and off, and a power transformer for supplying power to the control box, the electric wire disposed at said main trunk being connected to said control box and to said power transformer.

6. An artificial tree structure with decorative lamps, comprising:

a main trunk serving as a foundation;

a plurality of detachable legs disposed below a base of said main trunk and being equally spaced from each other;

a plurality of hollow tubes having various lengths and being disposed around said main trunk and roughly spaced equally from each other and arranged from a bottom to a top of said main truck in the shape of tree branches;

dense leaves disposed around an exterior of said hollow tubes;

a plurality of lamp bulbs, with at least one lamp bulb being disposed on each respective hollow tube and at an outermost distal end thereof so as to be coaxially arranged with said hollow tube; and a plurality of electric wires, at least one electric wire being disposed at said main trunk, and at least one electric wire being disposed inside each respective hollow tube, the respective electric wires disposed inside the hollow tubes being electrically connected to the respective lamp bulbs and to the electric wire disposed in at said main trunk.

7. The artificial tree structure recited in claim 6 wherein said lamp bulbs cap the ends of the respective hollow tubes.

8. The artificial tree structure recited in claim 6 further comprising lamp holders installed on the hollow tubes, the respective electric wires inside the respective hollow tubes being connected with the lamp holders, the lamp holders being electrically connectable with or disconnectable from the lamp bulbs, the lamp holders capping the ends of the respective hollow tubes.

* * * * *